US011365934B2

(12) United States Patent
Jheng

(10) Patent No.: US 11,365,934 B2
(45) Date of Patent: Jun. 21, 2022

(54) AIR-GUIDING STRUCTURE OF SEPARABLE HAND DRYER

(71) Applicant: HOKWANG INDUSTRIES CO., LTD., New Taipei (TW)

(72) Inventor: Cing-Fong Jheng, New Taipei (TW)

(73) Assignee: HOKWANG INDUSTRIES CO., LTD., New Taipei (TW)

( * ) Notice: Subject to any disclaimer, the term of this patent is extended or adjusted under 35 U.S.C. 154(b) by 315 days.

(21) Appl. No.: 16/828,015

(22) Filed: Mar. 24, 2020

(65) Prior Publication Data

US 2021/0302098 A1 Sep. 30, 2021

(51) Int. Cl.
*F26B 21/00* (2006.01)
*A47K 10/48* (2006.01)

(52) U.S. Cl.
CPC ..... *F26B 21/004* (2013.01); *A47K 10/48* (2013.01); *F26B 21/001* (2013.01)

(58) Field of Classification Search
CPC ..... F26B 21/001; F26B 21/004; A47K 10/48; H01R 4/60; H01R 4/646; H01R 4/66; H01R 4/64; H02G 3/06; H02G 3/22; H01B 7/04–048; Y10S 439/939
See application file for complete search history.

(56) References Cited

U.S. PATENT DOCUMENTS 1,827,086 A * 10/1931 Josephh ..... H02G 3/06 285/392
2,053,808 A * 9/1936 Young ..... H02G 3/06 285/289.1
2,222,438 A * 11/1940 Manson ..... H02G 3/06 174/652
2,651,767 A * 9/1953 Bergan ..... H01R 4/60 174/94 R
2,708,786 A * 5/1955 Watson ..... B21D 53/86 228/155
3,096,762 A * 7/1963 Winchell ..... A61M 15/02 128/202.25

(Continued)

FOREIGN PATENT DOCUMENTS

DE 102016109048 A1 * 11/2017 ..... F16L 3/085
FR 2863682 A1 * 6/2005 ..... F16L 47/32

(Continued)

*Primary Examiner* — Edelmira Bosques
*Assistant Examiner* — Bao D Nguyen
(74) *Attorney, Agent, or Firm* — Muncy, Geissler, Olds & Lowe, PC

(57) ABSTRACT

An air-guiding structure of a separable hand dryer, the separable hand dryer comprises an air outlet faucet and a working machine connected by the air-guiding structure. The air outlet faucet comprises at least one electrical wire and a ground wire. The air-guiding structure comprises an air pipe and an adapter pipe, and the shape of the air pipe is adjusted by an adjustment manner so that one end of the air pipe is fitted a position of the working machine and the air outlet faucet. The adapter pipe comprises a trunk, a manifold communicating with the trunk and allowing the electrical and ground wires to pass therethrough, and a seal provided in the manifold allows the electrical and ground wires to pass through but to restrict the passage of air. The trunk is connected to the air pipe, and the adapter pipe is adjusted by the adjustment manner.

10 Claims, 6 Drawing Sheets

(56) References Cited

U.S. PATENT DOCUMENTS 3,711,633 A * 1/1973 Ghirardi ..... H02G 15/18 285/133.11
3,861,422 A * 1/1975 Christie ..... F16L 55/172 174/92
4,015,634 A * 4/1977 Christie ..... F16L 58/188 285/373
5,765,242 A * 6/1998 Marciano ..... E03C 1/057 4/628
5,769,029 A * 6/1998 Marshall ..... A01K 13/001 119/651
5,950,867 A * 9/1999 Martindale ..... B67D 7/02 222/61
6,226,450 B1 * 5/2001 Lee ..... H05B 3/342 392/384
6,705,023 B1 * 3/2004 Hoover ..... A47K 10/48 392/382
6,715,217 B1 * 4/2004 Wright ..... F26B 9/006 34/448
9,856,635 B1 * 1/2018 Liu ..... E03C 1/057
10,945,569 B1 * 3/2021 Varghese ..... F24H 9/2071
2002/0079697 A1 * 6/2002 Griffioen ..... G02B 6/4476 285/133.11
2004/0108941 A1 * 6/2004 Hauck ..... H04B 3/58 340/870.07
2004/0213559 A1 * 10/2004 Schafer ..... A47K 10/48 392/382
2008/0277015 A1 * 11/2008 Tanaka ..... H02G 3/0468 138/121
2009/0273261 A1 * 11/2009 Fournier ..... E04H 12/2292 312/237
2012/0291195 A1 * 11/2012 Courtney ..... E03C 1/0404 4/638
2014/0150177 A1 * 6/2014 Hartley ..... E03C 1/22 29/874
2014/0154966 A1 * 6/2014 Joynt ..... F04D 29/663 454/338
2014/0259735 A1 * 9/2014 Muderlak ..... F26B 20/00 454/256
2015/0159951 A1 * 6/2015 Liu ..... A47K 10/48 34/565
2015/0164288 A1 * 6/2015 Courtney ..... F26B 21/004 34/90
2015/0164289 A1 * 6/2015 Courtney ..... A47K 10/00 34/90
2015/0208881 A1 * 7/2015 Zaminato ..... A47K 3/281 34/232
2017/0022692 A1 * 1/2017 Wang ..... E03C 1/0404
2017/0356173 A1 * 12/2017 Loberger ..... A47K 5/12
2019/0032310 A1 * 1/2019 Mott ..... A61H 33/08
2019/0045983 A1 * 2/2019 Chou ..... F26B 21/004
2019/0186833 A1 * 6/2019 Skiffington ..... F26B 21/004
2019/0282041 A1 * 9/2019 Moe ..... A47K 1/12
2020/0015640 A1 * 1/2020 Tracy ..... A47K 10/48
2020/0056843 A1 * 2/2020 Pasching ..... B60S 3/044

FOREIGN PATENT DOCUMENTS

GB 2530413 A * 3/2016 ..... A47K 10/48
GB 2530413 A 3/2016
JP 10169847 A * 6/1998 ..... B29C 65/342
WO WO-9730499 A1 * 8/1997 ..... H02G 3/06
WO WO2016/042315 A1 3/2016
WO WO-2016042315 A1 * 3/2016 ..... A47K 10/48
WO WO-2019188662 A1 * 10/2019 ..... B60R 16/0215
WO WO-2020245742 A1 * 12/2020 ..... H02G 15/113

* cited by examiner

AIR-GUIDING STRUCTURE OF SEPARABLE HAND DRYER

FIELD OF THE INVENTION

The present invention relates to an air-guiding structure of separable hand dryer, and more particularly to an air-guiding structure of separable hand dryer capable of preventing wires from entangling with each other during assembling.

BACKGROUND OF THE INVENTION

A technical structure that one end of the air duct is connected with the adapter pipe of the hand dryer is shown in the figures and the specification of the patent No. WO 2016042315A and its corresponding patent No. GB 2530413A. As shown in FIG. 1, WO 2016042315A provides a hand dryer 70 which comprises a hand dryer faucet 71, an adapter pipe 72 connected to the hand dryer faucet 71, an air duct 73 connected to the adapter pipe 72, and a machine (not shown in the figure) connected to the air duct 73 and supplying air to the hand dryer faucet 71 via the air duct 73. During the assembly process of the hand dryer 70, the hand dryer faucet 71 and the air duct 73 are respectively connected with the adapter pipe 72, and a plurality of electrical wires 711 electrically connected to the hand dryer faucet 71 are inserted into the adapter pipe 72 and come out from an opening 721 of the adapter pipe 72, and thereby the electrical wires 711 are connected to the machine. Further, the conventional adapter pipe 72 comprises a cap 722 and a pipe 723 which forms the opening 721 with the cap 722. The cap 722 and the pipe 723 are assembled by screwing, that is, the electrical wires 711 are inserted through the cap 722 during assembly, and the electrical wires 711 pass through the opening 721, and then the pipe 723 is screwed to connect with the cap 722. Therefore, the cap 722 and the pipe 723 press the electrical wires 711 to restrict the assembly positions of the electrical wires 711. However, the structures mentioned in WO 2016042315A may cause the problem that the adapter pipe 72 and the air duct 73 are liable to rotate relative to each other during assembly, which causes the electrical wires 711 to be easily entangled.

SUMMARY OF THE INVENTION

A main object of the present invention is to solve the problem caused by the conventional structure that easily leads to wrong entanglement between wires.

In order to achieve the above object, the present invention provides an air-guiding structure of separable hand dryer, the separable hand dryer comprises an air outlet faucet and a working machine separated from the air outlet faucet. The air outlet faucet and the working machine are connected by the air-guiding structure. The air outlet faucet comprises at least one electrical wire connected to the working machine and a ground wire connected to the working machine. The air-guiding structure comprises an air pipe and an adapter pipe assembled with one end of the air pipe, and the shape of the air pipe is adjusted by an adjustment manner to allow one end of the air pipe to be fitted in a position of the working machine or the air outlet faucet, wherein the adjustment manner is to rotate the air pipe or bend the air pipe. The adapter pipe comprises a trunk, a manifold communicating with the trunk and allowing the electrical wire and the ground wire, which penetrate the adapter pipe to pass therethrough, and a seal provided in the manifold to allow the electrical wire and the ground wire to pass through but to restrict the passage of air. The trunk is connected to the air pipe at one end, and the adapter pipe is unrotatable relative to the air pipe when the air pipe is adjusted by the adjustment manner, so as to prevent the electrical wire from entangling with the ground wire.

In one embodiment, the adapter pipe comprises two half-shells.

In one embodiment, the two half-shells are assembled in a pivotal manner.

In one embodiment, each of the half-shells comprises an assembling portion disposed at one side used to form the manifold, and a pivoting portion disposed at one side not used to form the manifold.

In one embodiment, one end of the trunk not connected to the air pipe is assembled with the working machine.

In one embodiment, the working machine comprises a hand-drying air generating module connected to the air-guiding structure and controlled by signals transmitted by the electrical wire, and a box for accommodating the hand-drying air generating module therein, the box is provided with at least one electrical connector for connecting the electrical wire, and the hand-drying air generating module is electrically connected to the electrical wire through the electrical connector.

In one embodiment, the box comprises a ground post disposed on a surface of the box and provided for disposing the ground wire.

In one embodiment, one end of the trunk not connected to the air pipe is assembled with the air outlet faucet.

Through the foregoing disclosure of the present invention, compared with the prior art, the present invention has the following features: through one end of the air pipe assembled with the adapter pipe, and the adapter pipe does not rotate relative to the air pipe when the air pipe is adjusted by the adjustment manner, and thereby the present invention prevents the electrical wire from entangling with the ground wire.

DETAILED DESCRIPTION OF THE PREFERRED EMBODIMENTS

Figure 1:
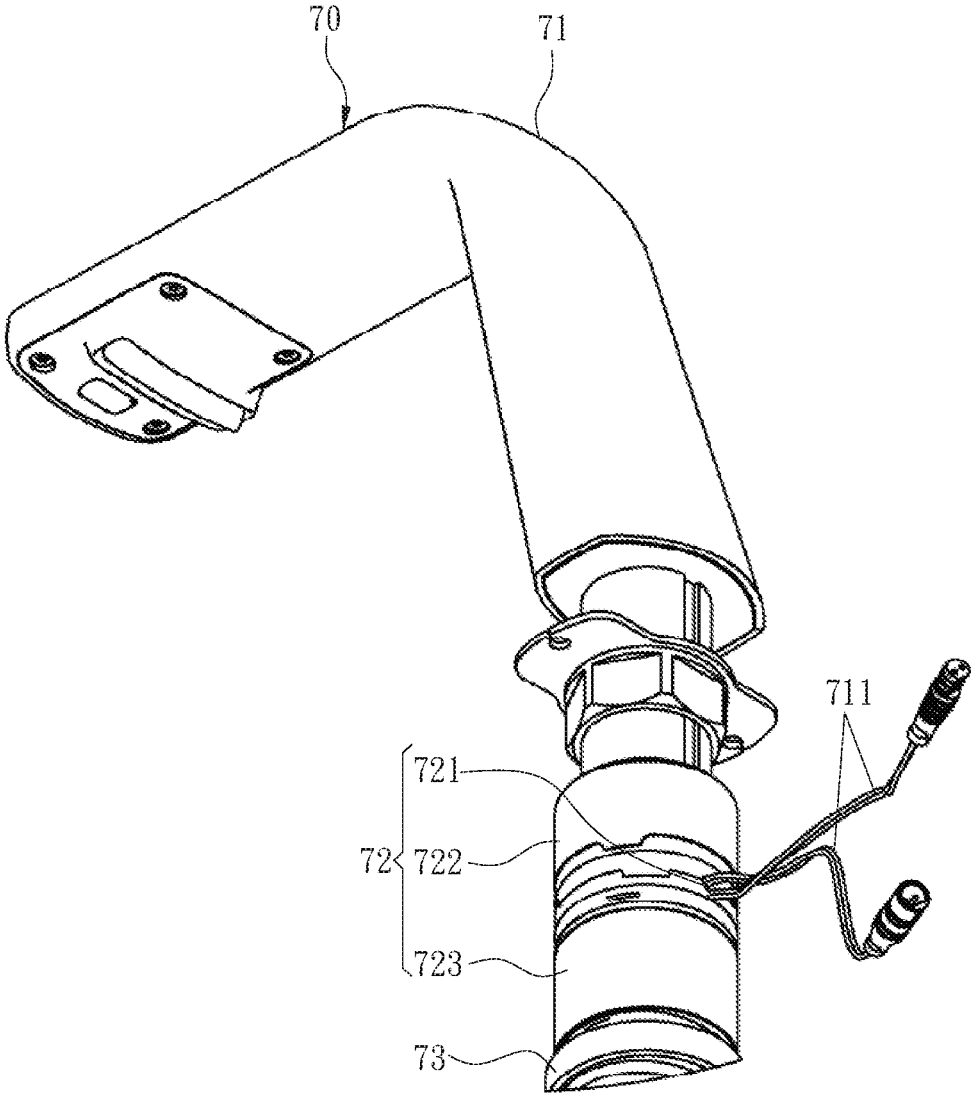
Fig. 1 PRIOR ART
FIG. 1 is a perspective structural view of the prior art.

The detailed description and technical contents of the present invention are described below with reference to the drawings.

Please refer to FIG. 2, FIG. 3, FIG. 4 and FIG. 5. The present invention provides an air-guiding structure 13, and the air-guiding structure 13 is applied to a separable hand dryer 10. The separable hand dryer 10 comprises an air outlet faucet 11 and a working machine 12, wherein the air outlet faucet 11 is disposed on a platform surface (not shown in the drawings), and the working machine 12 is disposed under the platform surface to be separated from the air outlet faucet 11. In addition, the air outlet faucet 11 and the working machine 12 are connected by the air-guiding structure 13. The air outlet faucet 11 comprises at least one electrical wire 111 connected to the working machine 12, and a ground wire 112 connected to the working machine 12.

Figure 2:
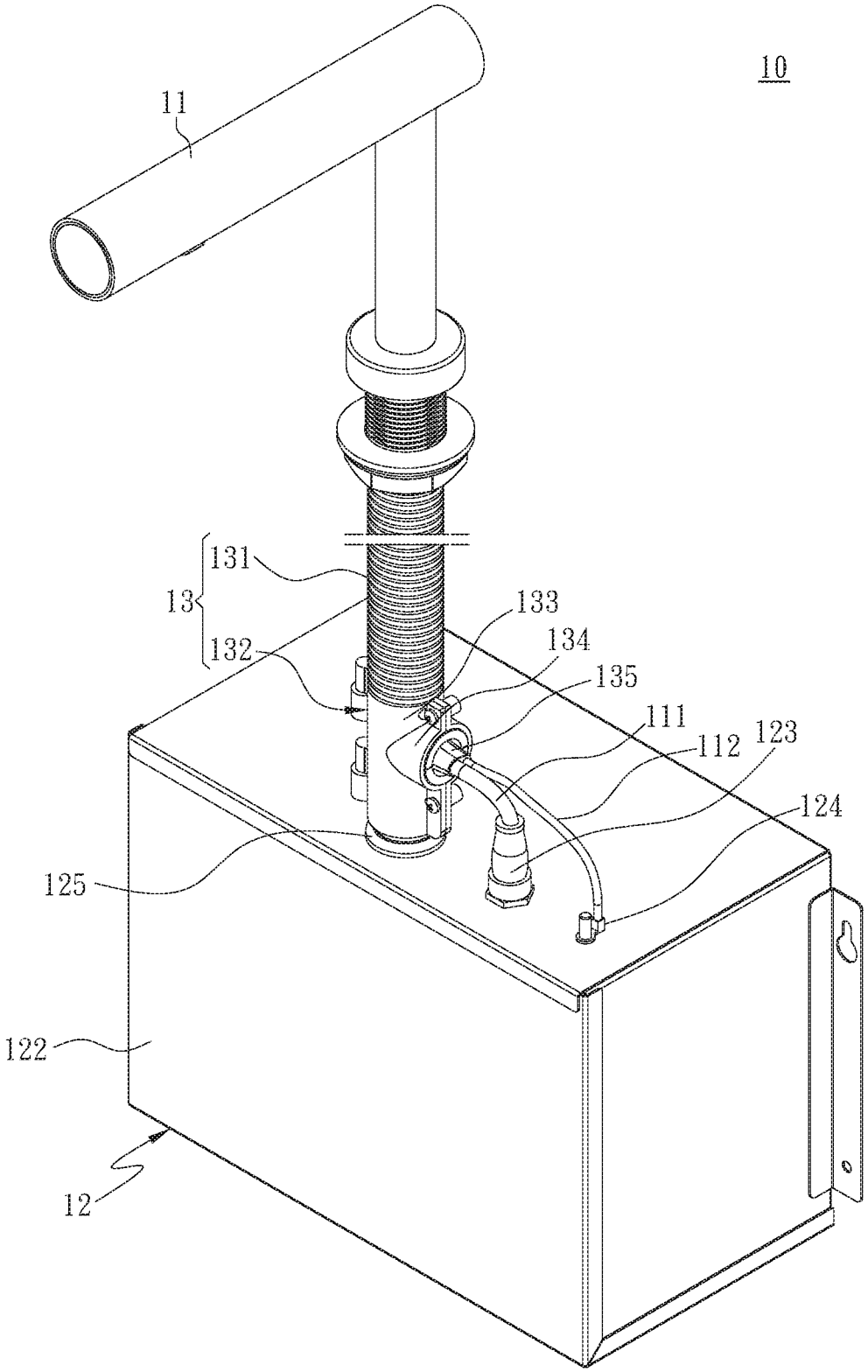
FIG. 2 is a first perspective view of the assembly of an air-guiding structure and a separable hand dryer of an embodiment of the present invention.
Figure 3:
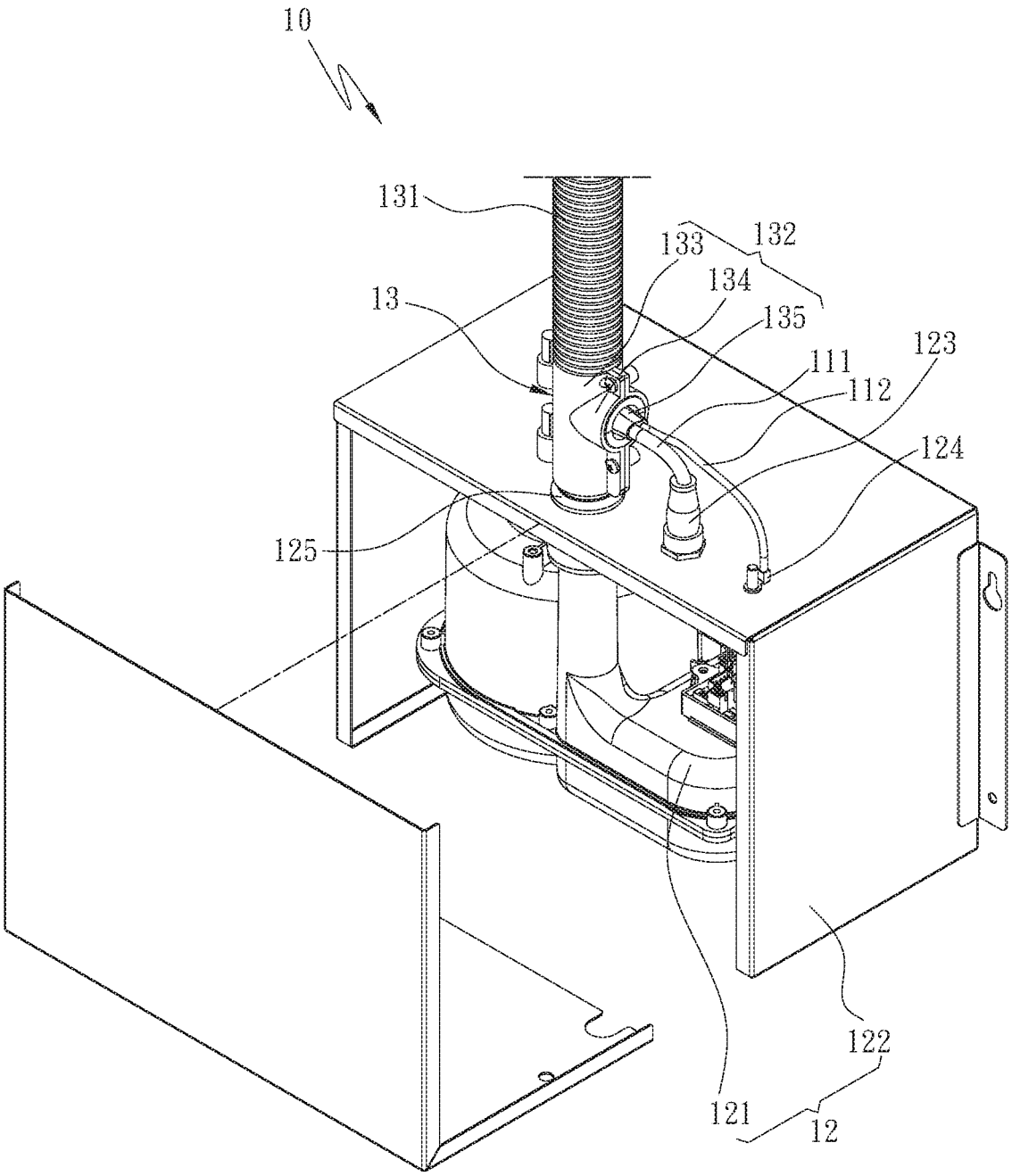
FIG. 3 is a second perspective view of the assembly of the air-guiding structure and the separable hand dryer of an embodiment of the present invention.
Figure 4:
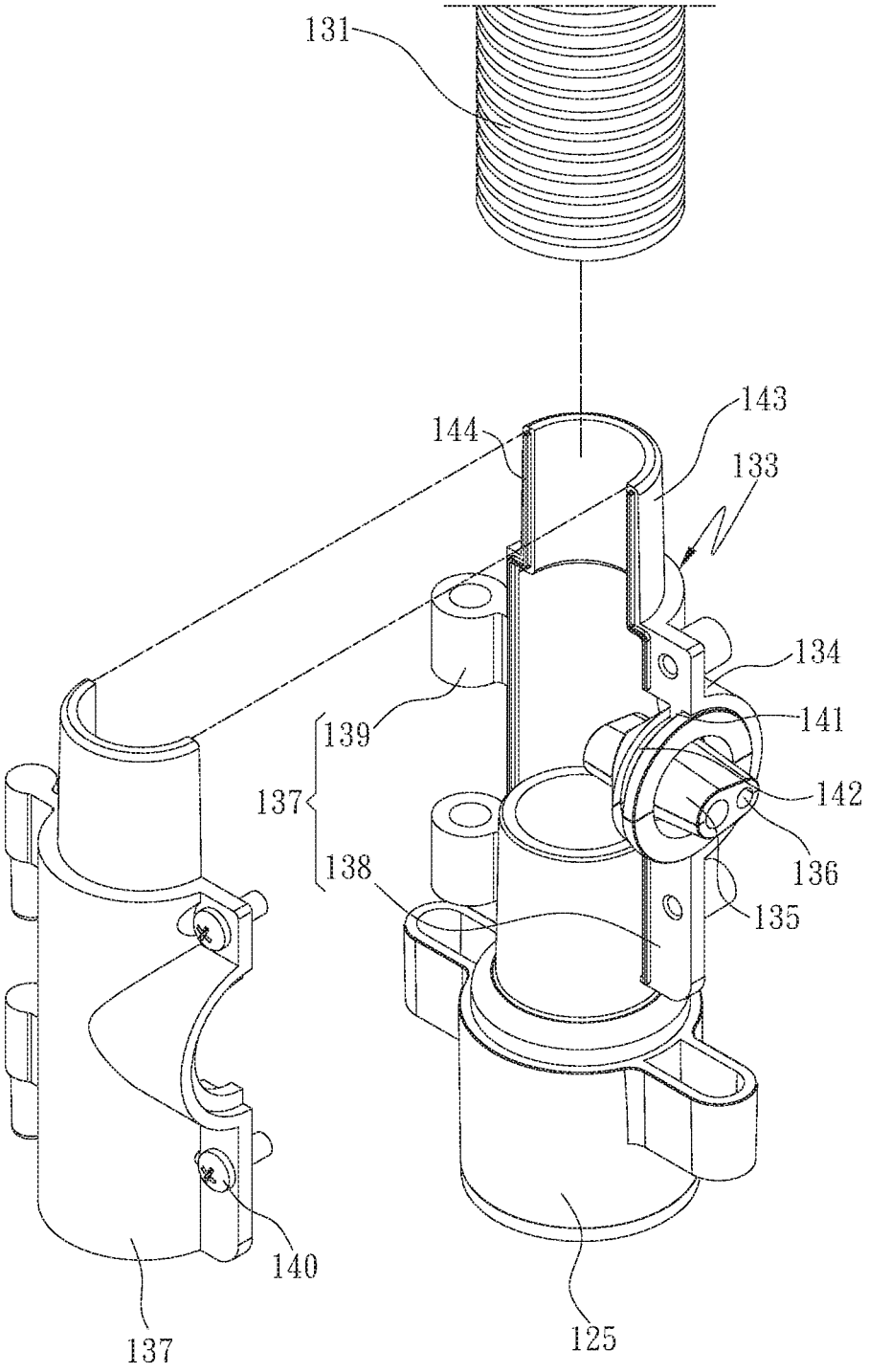
FIG. 4 is a perspective exploded view of an adapter pipe of an embodiment of the present invention.

Please refer to FIG. 2, FIG. 3, and FIG. 4. The air-guiding structure 13 comprises an air pipe 131 and an adapter pipe 132 assembled with the air pipe 131. The shape of the air pipe 131 is adjusted by an adjustment manner to allow one end of the air pipe to be fitted in a position of the working machine 12 or the air outlet faucet 11. For example, the air pipe 131 is assembled on the separable hand dryer 10 by various assembly methods such as turning the air pipe 131 or bending the air pipe 131, and the adjustment manner referred to herein is the aforementioned methods for assembling the air pipe 131. Further, after the air pipe 131 is adjusted by the adjustment manner, one end of the air pipe 131 is connected to the air outlet faucet 11 or the working machine 12. Firstly, the embodiment that one end of the air pipe 131 is assembled with the air outlet faucet 11 is explained as follow. The other end of the air pipe 131 not connected with the air outlet faucet 11 is connected with the adapter pipe 132, and the other end of the adapter pipe 132 not connected with the air pipe 131 is connected to the working machine 12. On the other hand, please refer to FIG. 6, if one end of the air pipe 131 is assembled with the working machine 12, the other end of the air pipe 131 not assembled with the working machine 12 is also assembled with the adapter pipe 132, and the other end of the adapter pipe 132 not assembled with the air pipe 131 is assembled with the air outlet faucet 11. The air pipe 131 depicted in the figures is only for illustration, that is, shape and form of the air pipe 131 after being assembled can be a bend or straight as shown in the figures according to the disposed positions of the air outlet faucet 11 and the working machine 12. In addition, the assembly manner between the air outlet faucet 11, the working machine 12, and the air-guiding structure 13 shown in the figures is only for illustration, and the assembly manner between the aforementioned components is not limited thereto.

Please refer to FIG. 2, FIG. 3, FIG. 4, and FIG. 5. The adapter pipe 132 comprises a trunk 133 communicating with the air pipe 131, a manifold 134 communicating with the trunk 133, and a seal 135 provided in the manifold 134. In one embodiment that one end of the air pipe 131 is connected to the adapter pipe 132 and the other end of the adapter pipe 132 is assembled with the working machine 12, the electrical wire 111 and the ground wire 112 are disposed in the air pipe 131, and the trunk 133 is connected to the air pipe 131 at one end and provided for the electrical wire 111 and the ground wire 112 in the air pipe 131 to pass through the trunk 133. The other end of the trunk 133 which is not connected to the air pipe 131 is assembled with the working machine 12. The manifold 134 is disposed on one side of the trunk 133 and is not assembled with the working machine 12 or the air pipe 131, and the manifold 134 is provided for the electrical wire 111 and the ground wire 112, which penetrate the trunk 133, to pass therethrough. In addition, the seal 135 is disposed in the manifold 134, and the seal 135 is used to close the manifold 134 so that the air of the separable hand dryer 10 fails to flow out through the manifold 134. In one embodiment, the seal 135 is a rubber material. Further, the seal 135 restricts air flow but allows the electrical wire 111 and the ground wire 112 to pass through, resulting in the electrical wire 111 and the ground wire 112 penetrate from the manifold 134. In one embodiment, the seal 135 is formed with at least one wire groove 136. The wire groove 136 only allows the electrical wire 111 and the ground wire 112 to pass through but restricts the passage of air. On the other hand, when the working machine 12 is controlled to provide hand-drying air to the adapter pipe 132, the seal 135 restricts the flow direction of the hand-drying air so that the hand-drying air only flows along the direction of the trunk 133, and the adapter pipe 132 guides the hand-drying air to flow toward the air pipe 131 and causes the hand-drying air to be provided to the air outlet faucet 11.

Compared with the prior art, the present invention comprises the adapter pipe 132 which is unrotatable relative to the air pipe 131 when the air pipe 131 is adjusted by the adjustment manner, so as to prevent the electrical wire 111 from entangling with the ground wire 112. Further, in one embodiment, the adapter pipe 132 is also provided for accommodating the electrical wire 111 and the ground wire 112 in the air pipe 131 and the adapter pipe 132, thereby making the separable hand dryer 10 more aesthetic.

Figure 5:
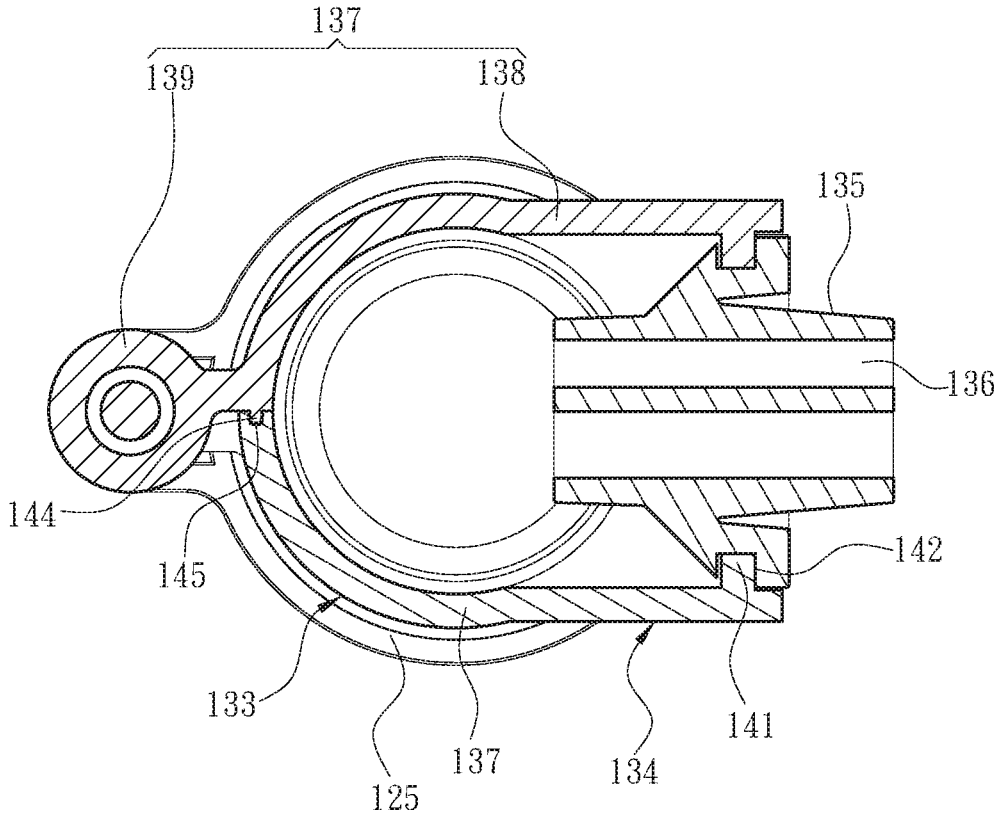
FIG. 5 is a cross-sectional view of the adapter pipe of an embodiment of the present invention.

Please refer to FIG. 3, FIG. 4, and FIG. 5. In one embodiment, the adapter pipe 132 comprises two half-shells 137, and the two half-shells 137 are assembled in a pivotal manner. Specifically, each of the half-shells 137 comprises an assembling portion 138 disposed at one side used to form the manifold 134, and a pivoting portion 139 disposed at one side not used to form the manifold 134, wherein the pivoting portion 139 of one of the two half-shells 137 comprises an assembling hole, and the pivoting portion 139 of the other half-shell 137 is an assembling post that matches and cooperates with the assembling hole. The two half-shells 137 pivot relative to each other by the assembling hole and the assembling post are assembled. Moreover, in one embodiment, the two pivoting portions 139 are assembled by an external plug pin. Furthermore, an assembling structure 140 is provided on the assembling portion 138 of each of the two half-shells 137. After the two half-shells 137 are assembled with the electrical wire 111 and the ground wire 112, the assembling structure 140 on one of the assembling portions 138 is assembled with the assembling structure 140 on the other one of the assembling portions 138, thereby limiting the assembly positions of the two half-shells 137. In one embodiment, after the two assembling portions 138 are assembled, the two assembling portions 138 are formed in a non-dismountable state or a selectively dismountable state. Thus, the invention provides the two half-shells 137 to be mutually assembled to form the adapter pipe 132, and the two half-shells 137 only need to be opened to allow the electrical wire 111 and the ground wire 112 to be penetrated into the adapter pipe 132, and then the two half-shells 137 are closed and assembled with each other to complete assembling of the adapter pipe 132. Compared with the prior art, the structures of the air-guiding structure 13 of the present invention are simpler and have the feature of easier assembly.

Please refer to FIG. 3, FIG. 4, and FIG. 5. In one embodiment, the adapter pipe 132 comprises at least one rib 141 disposed on one of the assembling portions 138 to make the seal 135 to stably dispose in the adapter pipe 132. The seal 135 comprises a ring groove 142 disposed around a surface of the seal 135, and the ring groove 142 matches and cooperates with the rib 141 to limit the position of the seal 135. In addition, the adapter pipe 132 comprises an auxiliary assembly portion 143 that communicates with one end of the trunk 133 facing the air pipe 131. The auxiliary assembly portion 143 is inserted into the air pipe 131 to assist assembling the trunk 133 with the air pipe 131. In one embodiment, a pipe diameter of the auxiliary assembly portion 143 is smaller than a pipe diameter of the trunk 133. Furthermore, the adapter pipe 132 comprises a first sealing structure 144 disposed on one of the two half-shells 137, and a second sealing structure 145 disposed on the other half-shell 137. The first sealing structure 144 matches and cooperates with second sealing structure 145 to prevent hand-drying air from leaking out between the two half-shells 137.

Please refer to FIG. 2, FIG. 3, FIG. 4, and FIG. 5. The working machine 12 comprises a hand-drying air generating module 121 connected to the air-guiding structure 13, and a box 122 for accommodating the hand-drying air generating module 121 therein. Specifically, the hand-drying air generating module 121 is electrically connected to the electrical wire 111 to be controlled by the electrical wire 111. The hand-drying air generating module 121 receives signals transmitted by the electrical wire 111 and performs a work based on the signal content. For example, when the hand-drying air generating module 121 receives an actuated signal from the electrical wire 111, the hand-drying air generating module 121 starts to operate and generates hand-drying air. In addition, the box 122 is used to shield the hand-drying air generating module 121 and provide protection for the hand-drying air generating module 121. The box 122 is provided with at least one electrical connector 123 for connecting the electrical wire 111, and the hand-drying air generating module 121 is electrically connected to the electrical wire 111 through the electrical connector 123. In one embodiment, the box 122 further comprises a ground post 124 disposed on a surface of the box 122 and provided for the ground wire 112 to dispose. Besides, to stably assemble the working machine 12 with the air-guiding structure 13, the working machine 12 comprises an auxiliary assembling pipe 125 provided in the box 122 and extending in a direction facing the air-guiding structure 13. The auxiliary assembling pipe 125 communicates with the hand-drying air generating module 121 and receives the hand-drying air from the hand-drying air generating module 121, so that the hand-drying air generating module 121 can output the hand-drying air to the air-guiding structure 13.

Figure 6:
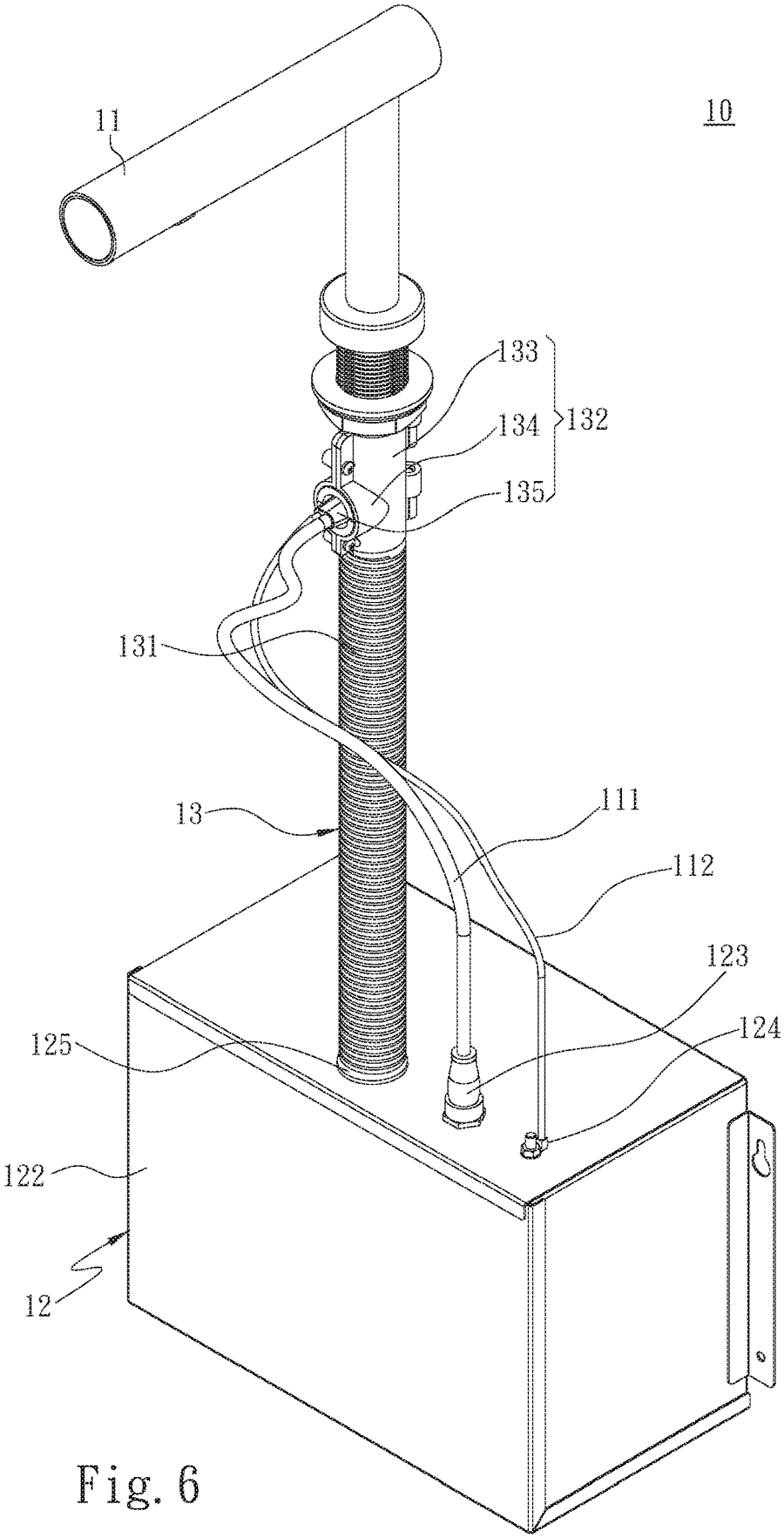
FIG. 6 is a perspective view of the assembly of the air-guiding structure and the separable hand dryer of another embodiment of the present invention.

In addition to the foregoing, please refer to FIG. 6 for the air-guiding structure 13 connected to the air outlet faucet 11 and the working machine 12 in another implementation. The structures of the air pipe 131, the adapter pipe 132, the air outlet faucet 11, and the working machine 12 in this implementation are the same as the structures mentioned in the previous description, and therefore will not be described again. In this embodiment, although one end of the trunk 133 of the adapter pipe 132 is also connected to the air pipe 131, the other end of the trunk 133 not connected to the air pipe 131 is assembled with the air outlet faucet 11. Consequently, during the implementation of the air-guiding structure 13, the assembly manner of the air pipe 131 and the adapter pipe 132 is not limited, and the working positions of the air pipe 131 and the adapter pipe 132 may be selected according to actual needs. In this way, the air-guiding structure 13 of the present invention is made to be more flexible in applications.

Note that the specification relating to the above embodiments should be construed as exemplary rather than as limitative of the present invention, with many variations and modifications being readily attainable by a person of average skill in the art without departing from the spirit or scope thereof as defined by the appended claims and their legal equivalents.

What is claimed is:

1. An air-guiding structure of a separable hand dryer, the separable hand dryer comprising an air outlet faucet and a working machine separated from the air outlet faucet, the air outlet faucet and the working machine connected by the air-guiding structure, the air outlet faucet comprising at least one electrical wire connected to the working machine and a ground wire connected to the working machine, the air-guiding structure comprising:

an air pipe, the shape of the air pipe is adjusted by an adjustment manner to allow one end of the air pipe to be fitted in a position of the working machine or the air outlet faucet, wherein the adjustment manner is to rotate the air pipe or to bend the air pipe; and an adapter pipe assembled with the other end of the air pipe, the adapter pipe comprising a trunk, a manifold communicating with the trunk and allowing the at least one electrical wire and the ground wire, which penetrate the adapter pipe, to pass therethrough, and a seal provided in the manifold to allow the at least one electrical wire and the ground wire to pass through but to restrict the passage of air, the trunk connected to the air pipe at one end, and the adapter pipe being unrotatable relative to the air pipe when the air pipe is adjusted by the adjustment manner, so as to prevent the at least one electrical wire from entangling with the ground wire.

2. The air-guiding structure of the separable hand dryer as claimed in claim 1, wherein the adapter pipe comprises two half-shells.

3. The air-guiding structure of the separable hand dryer as claimed in claim 2, wherein the two half-shells are assembled in a pivotal manner.

4. The air-guiding structure of the separable hand dryer as claimed in claim 3, wherein each of the half-shells comprises an assembling portion disposed at one side used to form the manifold, and a pivoting portion disposed at one side not used to form the manifold.

5. The air-guiding structure of the separable hand dryer as claimed in claim 1, wherein one end of the trunk not connected to the air pipe is assembled with the working machine.

6. The air-guiding structure of the separable hand dryer as claimed in claim 5, wherein the working machine comprises a hand-drying air generating module connected to the air-guiding structure and controlled by signals transmitted by the at least one electrical wire, and a box for accommodating the hand-drying air generating module therein, the box is provided with at least one electrical connector for connecting the at least one electrical wire, and the hand-drying air generating module is electrically connected to the at least one electrical wire through the at least one electrical connector.

7. The air-guiding structure of the separable hand dryer as claimed in claim 6, wherein the box comprises a ground post disposed on a surface of the box and provided for disposing the ground wire.

8. The air-guiding structure of the separable hand dryer as claimed in claim 1, wherein one end of the trunk not connected to the air pipe is assembled with the air outlet faucet.

9. The air-guiding structure of the separable hand dryer as claimed in claim 8, wherein the working machine comprises a hand-drying air generating module connected to the air-guiding structure and controlled by signals transmitted by the at least one electrical wire, and a box for accommodating the hand-drying air generating module therein, the box is provided with at least one electrical connector for connecting the at least one electrical wire, and the hand-drying air generating module is electrically connected to the at least one electrical wire through the at least one electrical connector.

10. The air-guiding structure of the separable hand dryer as claimed in claim 9, wherein the box comprises a ground post disposed on a surface of the box and provided for disposing the ground wire.

* * * * *